US006095689A

United States Patent [19]

Bochet

[11] Patent Number: 6,095,689

[45] **Date of Patent: *Aug. 1, 2000**

[54] FLEXIBLE BAG WITH INCORPORATED OPENING LINE

[75] Inventor: Thierry Bochet, Thouars, France

[73] Assignee: Socoplan S.A., Thouars, France

[ * ] Notice: Under 35 U.S.C. 154(b), the term of this patent shall be extended for 487 days.

[21] Appl. No.: 08/798,718

[22] Filed: Feb. 12, 1997

Related U.S. Application Data

[63] Continuation of application No. 08/388,843, Feb. 15, 1995, abandoned, which is a continuation-in-part of application No. 08/230,530, Apr. 20, 1994, abandoned.

[30] Foreign Application Priority Data

Dec. 16, 1993 [FR] France ..... 93 15151

[51] Int. Cl.[7] ..... B65D 33/00

[52] U.S. Cl. ..... 383/200; 383/209; 383/906

[58] Field of Search ..... 383/200, 203, 383/204, 207, 208, 209, 906

[56] References Cited

U.S. PATENT DOCUMENTS

| | | | |
|---|---|---|---|
| 2,499,528 | 3/1950 | Reitzes | 383/209 X |
| 3,146,912 | 9/1964 | Twersky | 383/209 X |
| 3,423,902 | 1/1969 | Stroop | 383/203 X |
| 4,363,406 | 12/1982 | Salvadori . | |
| 5,063,069 | 11/1991 | Van Erden et al. | 383/63 X |

FOREIGN PATENT DOCUMENTS

| | | | |
|---|---|---|---|
| 0 593 445 | 4/1994 | European Pat. Off. . | |
| 0 658 488 | 6/1995 | European Pat. Off. . | |
| 1.216.422 | 4/1960 | France . | |
| 2.126.578 | 10/1972 | France . | |
| 2 270 158 | 12/1975 | France . | |
| 5319442 | 12/1993 | Japan | 383/200 |
| 797584 | 7/1958 | United Kingdom | 383/200 |

*Primary Examiner*—Jes F. Pascua
*Attorney, Agent, or Firm*—Young & Thompson

[57] ABSTRACT

A bag (1) which includes at least two flexible but tearable walls (2, 3) placed opposite to one another, and a margin (4) for rigidly joining the two walls (2, 3) one against the other, disposed so as to delimit, on the one hand, the outer periphery (6 to 9) of the bag (1), and on the other hand, the outer contour (10 to 13) of a central volume (5) intended to contain a product which can be liquid, pasty or pulverulent, for example. There is a line (18) of weakest resistance which extends on the joining margin (4) and which is intended to allow the bag (1) to be opened by tearing the walls (2, 3). A first end (19) of the line of weakest resistance (18) is located at a peripheral edge (7) of the joining margin (4). At its second end (20) the line of weakest resistance (18) has a tangent (21) which intercepts the outer contour (10, 13) of the volume (5) in such a way that when the walls (2, 3) are torn along the line of weakest resistance (18), starting from the first end (19) and via the second end (20), an opening (22) with a substantially predetermined shape is achieved in the volume (5).

9 Claims, 3 Drawing Sheets

FLEXIBLE BAG WITH INCORPORATED OPENING LINE

This application is a continuation of application Ser. No. 08/388,843, filed Feb. 15, 1995, now abandoned, which is a continuation-in-part of Ser. No. 08/230,530, filed Apr. 20, 1994, now abandoned.

BACKGROUND OF THE INVENTION

1. Field of the Invention

The invention relates to a flexible bag with an incorporated opening line, a method for manufacturing such a bag, and a machine for manufacturing such a bag.

2. Background Art

The term "flexible bag" applies to any container made up of at least two walls consisting of sheets made of one or more materials flexible enough to be deformed without suffering damage under normal conditions of use.

But while being flexible, it must be possible for the user to easily cut or tear the walls so as to gain access to the product contained within without diminishing the bag's resistance.

For example, the walls can be made of a sheet of paper, a sheet of plastic material or a sheet of metal such as aluminum. They are often made out of a complex multilayered film.

Flexible bags are known of whose walls are located opposite to one another. They comprise a margin for rigidly joining the two walls together. The margin is disposed so as to delimit, on the one hand, the outer periphery of the bag, and, on the other hand, the outer contour of a central volume.

This central volume is intended to contain a product which can be liquid, pasty or pulverulent, for example. This product can consist of a fluid for nutritive, cosmetic, medical or household use.

Since this volume is surrounded, usually in an airtight manner, by the joining margin, an opening has to be formed in the walls of the bag to allow the product to be poured out.

Such an opening can be produced using a cutting tool such as a pair of scissors.

Another well known method involves providing, on the joining margin, a line of weakest resistance intended to allow the bag to be opened without using cutting tools, by tearing away or ripping the walls. A first end of the line of weakest resistance is generally located on the outer periphery of the bag.

But these bags display a number of disadvantages.

With certain materials which the walls are made of, it is not always possible to obtain a correct opening of the bag by tearing along the line of weakest resistance. This, for example, is the case with walls which comprise a layer of a material with a high tear strength, PET for example, or which is highly elastic, PE or PP for example.

On the other hand, if at least one wall comprises a layer of a material able to withstand significant elastic deformations without tearing, the opening obtained is not always well defined, and it is therefore not possible to pour out the product in a clean manner or to dose it precisely.

The tear often deviates from the direction along which one wishes it to be performed. This can result in parts of the walls being ripped without the bag being opened. The tear may also deviate towards the volume's interior, creating a breach such that the product has a tendency to leak out of the bag.

The arrangement and the limited dimensions of the known lines of weakest resistance make them difficult to locate and the grip provided is insufficient to allow for easy tearing.

BROAD DESCRIPTION OF THE INVENTION

The purpose of the invention is to eliminate these and other disadvantages and to provide a flexible bag whose manufacture is inexpensive and which is both mechanically resistant, so as to ensure an efficient protection of its contents, and easy to open.

An object of the invention is to provide a bag comprising two flexible but tearable walls placed opposite to one another; a margin for rigidly joining the two walls one against the other, disposed so as to delimit, on the one hand, the outer periphery of the bag, and, on the other hand, the outer contour of a central volume intended to contain a product which can be liquid, pasty or pulverulent, for example; and a line of weakest resistance which extends on the joining margin and which is intended to allow the bag to be opened by tearing the walls; a first end of the line of weakest resistance being located at a peripheral edge of the joining margin; characterized in that at its second end the line has a tangent which intercepts the outer contour of the volume in such a way that when the walls are torn along the line of weakest resistance, starting from the first end and via the second end, an opening with a substantially predetermined shape is achieved in the volume.

The walls of such a bag can be either distinct, and derived from two sheets of flexible material, for example, or these walls can be derived from one same sheet folded so as to obtain two walls opposite to one another.

The line of weakest resistance can consist of a thinning of the thickness of at least one wall, a stamped line, or a removal of material. The line of weakest resistance can be interrupted between its first and second ends by at least one fringing bridge. It can also extend along a peripheral edge of the joining margin having the greatest length. The line of weakest resistance can be substantially rectilinear and be disposed partly parallel to the peripheral edge along which it extends. At its first and second ends, the line of weakest resistance can be oriented towards the peripheral edge of the margin and towards the outer contour of the volume, respectively, so as to define a gripping strip on the margin.

In addition, the tangent of the line of weakest resistance at its second end, as well as a tangent of the outer contour of the volume, can define an angle of between 45 and 90°, and preferably in the order of 50 to 70°, at the point of interception of this contour with the tangent of the line of weakest resistance.

According to one embodiment, the bag has a gripping strip which is at least partly flared along the line of weakest resistance and starting from the first end. For example, the gripping strip is flared at least near the second end of the line of weakest resistance. The latter can extend along a peripheral edge which is delimited, near the first end, by an adjacent peripheral edge, the distance between the first end and this adjacent peripheral edge being greater than the width of the joining margin projecting on the peripheral edge where the line is extended, so as to create a retention area on the margin.

The line of weakest resistance can include at least one bent part and, for example, a bent part close to each of its first and second ends.

The volume can comprise, near the second end, a part protruding into the margin and towards a peripheral edge along which the line of weakest resistance is extended, so that the opening achieved in the volume upon tearing makes up a spout.

According to one embodiment, the part protruding from the volume is located between the second end of the line of weakest resistance and a peripheral edge adjacent to a peripheral edge along which the line of weakest resistance is extended. The peripheral edges of the joining margins form a polygon, preferably a rectangle.

Another object of the invention is to provide a method for manufacturing a bag such as defined above, characterized in that it comprises the successive steps consisting of:

- placing at least two flexible walls, derived from at least one sheet of flexible material, opposite to one another;
- rigidly joining the two walls so as to form a part of the margin and of the volume;
- filling the part of the volume with a product which is liquid, pasty or pulverulent, for example;
- completing the rigid joining of the two walls in order to complete the margin and seal the volume;
- forming a line of weakest resistance on the margin.

The advantage of this method with respect to those of the state of the art is that it makes it possible to separate the filling and joining steps.

Yet another object of the invention is to provide a machine for manufacturing a bag such as defined above, characterized in that it comprises:

- means suitable for placing at least two flexible walls opposite to one another, the walls being derived from at least one sheet of flexible but tearable material;
- means making it possible to rigidly join the two walls so as to form a part of the margin and of the volume;
- means for filling the part of the volume with a product which is liquid, pasty or pulverulent, for example;
- means making it possible to complete the margin and to seal the volume; and
- means suitable for forming a line of weakest resistance on the margin.

Depending on the embodiment, the machine can be disposed vertically or horizontally.

BRIEF DESCRIPTION OF THE INVENTION

The invention is described in detail with reference to the attached drawings in which.

DETAILED DESCRIPTION OF THE INVENTION

Figure 6:
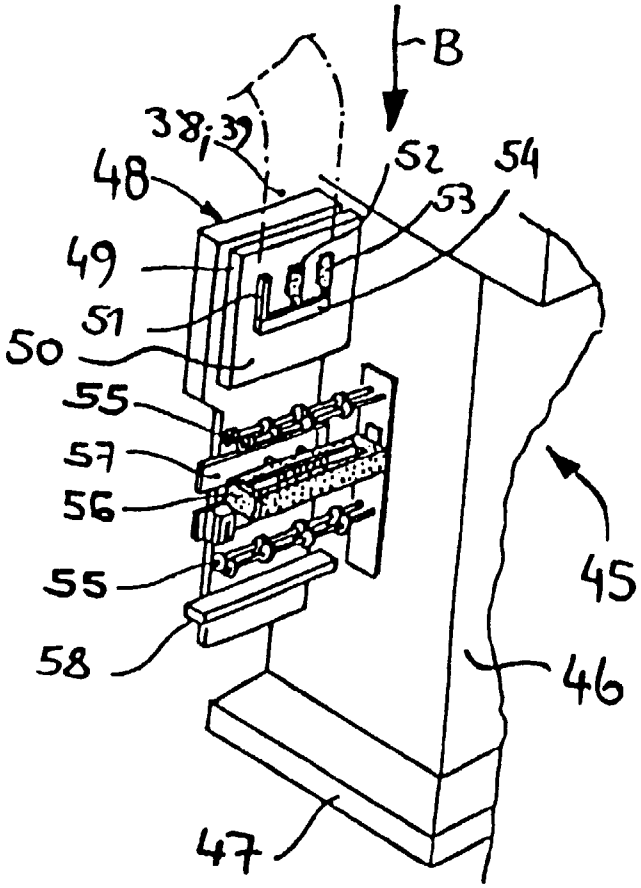
FIG. 6 is a partial, schematic perspective view of a machine making it possible to implement the vertical-feed method for producing bags in accordance with the invention.

In FIGS. 1 to 5 and 7, reference numeral 1 designates a flexible bag. The bag 1 comprises at least two flexible but tearable walls 2 and 3. The walls 2 and 3 are placed opposite to one another.

In a first embodiment, the two walls 2, 3 are distinct. In another embodiment, the walls 2, 3 are derived from one same folded sheet 59 made of flexible but tearable material.

A margin 4 for rigidly joining the walls of the bag 1 is disposed so as to delimit, on the one hand, the outer periphery of the bag 1, and, on the other hand, the outer contour of a central volume 5. The central volume 5 is intended to contain a product which can be liquid, pasty or pulverulent, for example. This product can be at least partly solid.

The bag 1 illustrated comprises two flexible walls 2 and 3 disposed opposite to one another. But the bag 1 can comprise more than two flexible walls joined by one or more margins 4. The walls can then be joined opposite to one another and preferably edge-to-edge.

In order to simplify the description, the bag 1 is assimilated to the plane defined by the two walls 2 and 3, and by the margin 4. Obviously, in reality the envelope of the bag 1 has a certain thickness.

Similarly, although the bags 1 illustrated have a polygonal shape, and more specifically rectangular, bags 1 can be provided whose outer peripheries have any shape whatsoever, rounded off for example.

Figure 1:
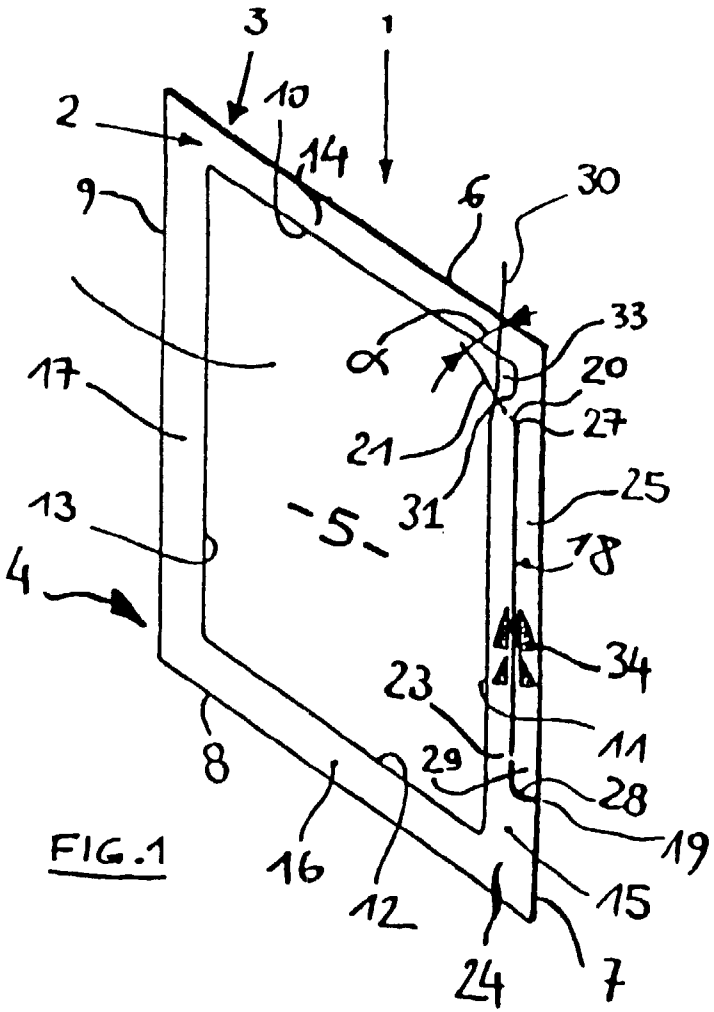
FIG. 1 is a perspective view of a bag in accordance with the invention.

In FIG. 1, the outer periphery of the bag 1 is made up of peripheral edges 6, 7, 8 and 9. Edges 6 and 8 are parallel to each other, and are delimited between their ends by adjacent edges 7 and 9. Peripheral edges 7 and 9 are parallel to each other, and extend perpendicularly to adjacent edges 6 and 8. The outer contour of the central volume 5 is essentially defined by adjacent sections 10, 11, 12 and 13, which are parallel to peripheral edges 6, 7, 8 and 9, respectively.

In the case where walls 2, 3 are derived from a single folded sheet 59, the fold of the sheet can correspond to one of the peripheral edges of the bag 1, such as edge 8 for example.

The margin 4 is substantially divided into four adjacent parts 14, 15, 16 and 17. Part 14 of the margin 4 is delimited, on the one hand, by the peripheral edge 6 and, on the other hand, by section 10 of the outer contour of the volume 5. The same is true for part 15 with edge 7 and section 11, part 16 with edge 8 and section 12, as well as for part 17 with edge 9 and section 13.

In the case where the walls 2, 3 are derived from one same folded sheet, the folded edge can be joined or not joined. Here one can see that folded edge 8 is also joined and delimits part 16 of the margin.

The smallest dimension of the bag 1 illustrated is parallel to edges 6 and 8. Edges 7 and 9, volume contour sections 11 and 13, as well as parts 15 and 17 of the margin therefore have the largest dimension or length of the bag 1.

On the margin 4, the bag 1 comprises a line of weakest resistance 18. Here the line 18 extends on part 15 of the margin 4. It has a first end 19 located at peripheral edge 7.

This line 18 is intended to allow the bag 1 to be opened by tearing part of walls 2 and 3.

The line of weakest resistance 18 has, at its second end 20, a tangent 21 which intercepts section 11 of the outer contour of the volume 5.

Thus, when the walls 2 and 3 are torn along the line of weakest resistance 18, starting from the first end 19 and via the second end 20, an opening 22 (FIG. 5) with a substantially predetermined shape is achieved in the volume 5.

The line of weakest resistance 18 can be obtained in several ways. It can consist of a thinning of the thickness of at least one wall 2, or 3, as well as a stamped line, or a removal of material.

Here, the line 18 is interrupted between its first end 19 and its second end 20 by a fringing bridge 23. Several fringing bridges can be disposed along the line 18.

The line of weakest resistance 18 is partly substantially rectilinear and extends along edge 7, which is one of the two longest edges of the bag 1. The rectilinear part of the line 18 is disposed parallel to peripheral edge 7. Measured as an orthogonal projection on edge 7, the distance between the first end 19 and the adjacent peripheral edge 8 facing the second end 20 along edge 7 is greater than the width of the joining margin 4 measured in the same manner, i.e., than the distance on edge 7 between the adjacent edge 8 and part 16 of the contour.

It is thus possible to give the line of weakest resistance 18 a significant length while creating a retention area 24 between the first end 19 and the adjacent edge 8. The dimensions of the area 24 are sufficient to allow the user to hold the bag 1 firmly between end 19 and edge 8.

The line 18 defines a gripping strip 25 on the margin 4. The strip 25 is at least partly flared along the line 18 and starting from the first end 19. In other words, the second end 20 is farther from peripheral edge 7, along a direction parallel to adjacent edge 6, than rectilinear part 26. Although the strip 25 can be flared throughout its entire length, here it is flared only near the second end 20.

The flared part of the strip 25 is defined by a bent part 27 (FIG. 3) of the line 18 oriented towards the outer contour of the volume 5, and here towards its section 11. In addition, near the first end 19 the line of weakest resistance 18 has another bent part 28 oriented towards peripheral edge 7. Projected on this edge, the bent part 28 is located between the fringing bridge 23 and the first end 19. The bent part 28 defines an end 29 of the strip 25 which here is integrated into the margin 4.

Here the bent part 28 is disposed so that the tangent 21, on the one hand, and a tangent 30 of section 11 of the outer contour of the volume 5, on the other hand, define an angle of between 45 and 90° at a point of interception 31 of this contour with the tangent 21. The angle is preferably in the order of 50 to 70°, In FIGS. 1, 3 and 4, a part 33 of the volume 5 provided near the second end 20 protrudes into part 15 of the margin 4, towards peripheral edge 7. Here the protruding part 33 is delimited by the intersection of the adjacent sections 10 and 11 of the external contour of the volume 5. It is located between the second end 20 and the peripheral edge 6 adjacent to the peripheral edge 7.

The method for opening a bag 1, as well as the advantages provided by its structure, will now be described with reference to FIGS. 3 to 5.

Figure 3:
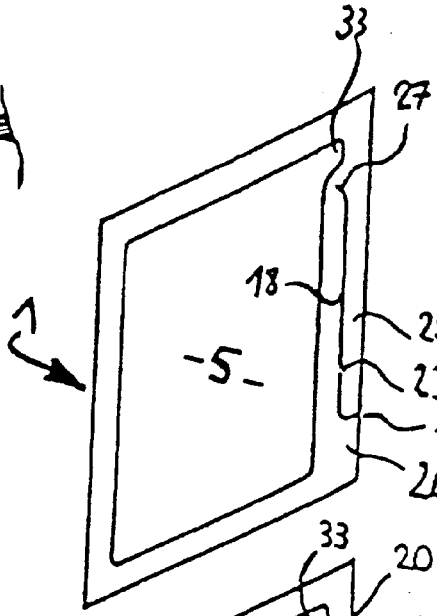
FIGS. 3, 4 and 5 are perspective views of the bag shown in FIG. 1, in three successive opening phases.

Before being opened, the bag 1 is as shown on FIGS. 1 and 3. A person or user wishing to discharge at least part of the product contained in the volume 5 can hold the retention area 24 between the fingers of a hand.

With the fingers of the other hand, the user can seize the strip 25. The dimensions of the retention area 24 and the length of the strip 25 allow for a good hold.

Figure 4:
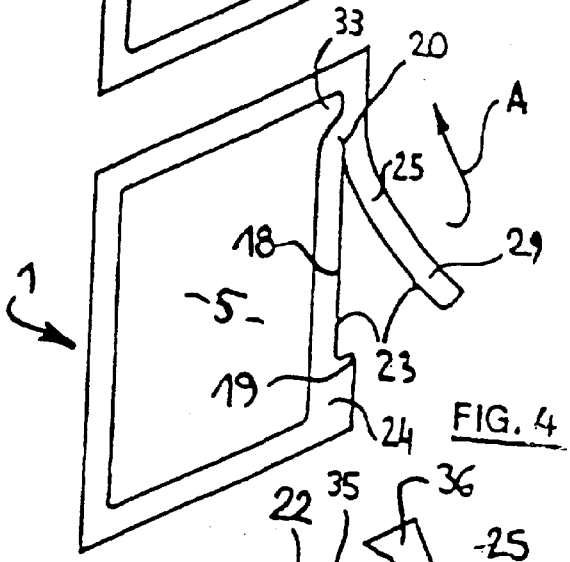
Figure 5:
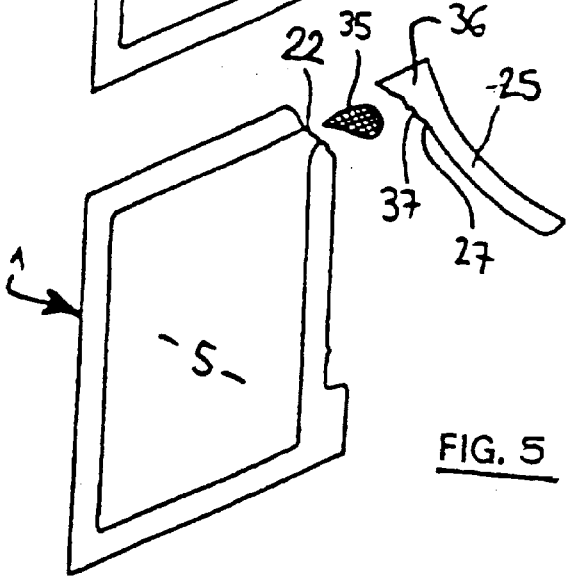

While holding on to area 24, a pull is exerted on the strip 25 along the line 18 as indicated by arrow A (FIG. 4). End 29 of the strip 25 can be freed, and the fringing bridge 23 broken.

By continuing the pulling indicated by arrow A, the tearing point of the walls 2 and 3 of the bag 1 is displaced towards the second end 20 the line 18.

When the tearing point reaches the bent part 27, the tearing force along arrow A is transmitted to walls 2 and 3 by a section of increasing size measured parallel to edge 6. This makes it possible to keep the strip from breaking when tearing the walls beyond the second end 20 (FIG. 5).

As of the phase shown in FIG. 4, if the pulling along arrow A is pursued, the tearing point leaves the line of weakest resistance 18 and forms a torn edge 37. The orientation given to the bent part 27 enables the tear to be performed in a clean and well defined manner.

Once the tearing is finished (FIG. 5), the strip 25 can be completely detached from the rest of the bag 1. When the walls 2 and 3 are torn beyond the second end 20, the strip 25 takes along with it a part 36 delimited by what previously formed a corner of the bag 1 between the edges 6 and 7, as well as by the torn edge 37.

Furthermore, the opening 22 resulting from this tearing, which cuts the protruding part 33 of the volume 5, has the shape of a spout. This spout makes it possible to pour the product out of the volume 5 in a dosed manner, and at a chosen location. For example, if the product is a fluid, it is possible to dose a drop 35 of the product, and to place it with precision on any substrate whatsoever.

The angle is preferably determined so that the torn edge 37 is oriented in a direction along which the material of the walls 2 and 3 displays the lowest possible tear strength characteristics.

Referring to FIG. 1, it can be seen that the bag 1, and, for example, the part 15 of the margin 4 which includes the line of weakest resistance 18, can be covered with a print 34 or similar.

Such a print can be part of an ornamental motif extending over other parts of the bag. But the print 34 can also have an informative purpose. Here, it represents an arrow indicating the direction along which the tearing of the line 18 must be performed.

Figure 2:
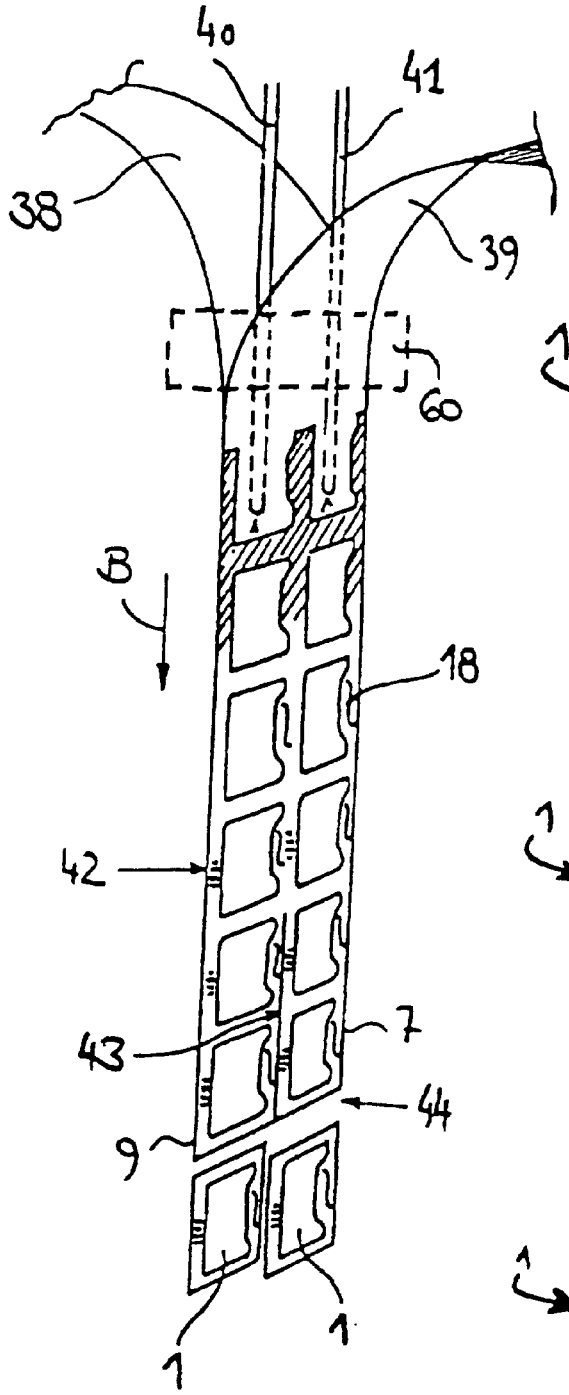
FIG. 2 is a partial schematic view which illustrates a method for producing bags according to the invention.
Figure 7:
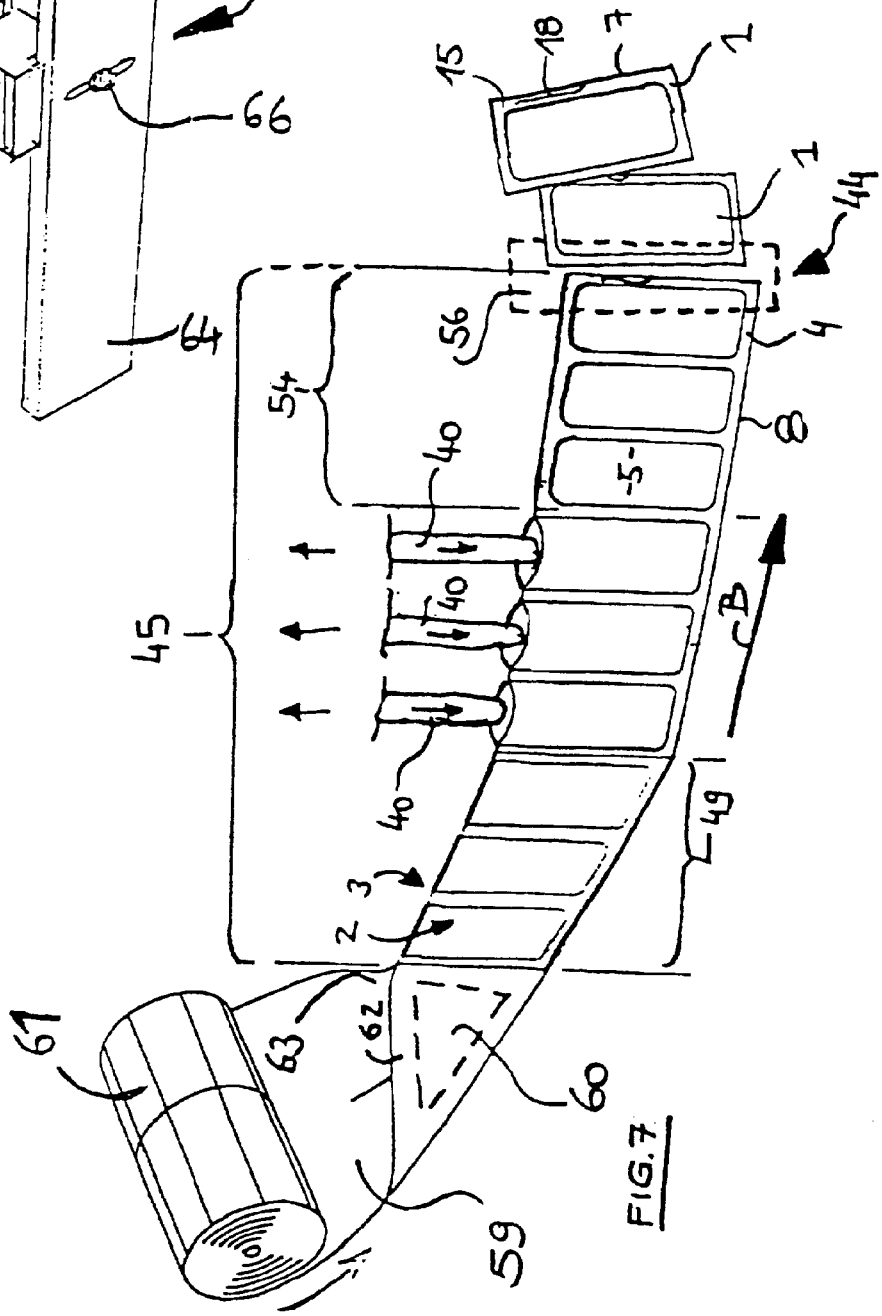
FIG. 7 is a partial schematic view similar to FIG. 2, but in the case of a machine making it possible to implement a method for producing bags by folding and horizontally feeding a single sheet.

FIGS. 2 and 7 illustrate examples of methods for producing bags 1. Given the explanations which follow and the state of the art, those skilled in the art will know how to implement these methods.

In the case (FIG. 2) where the two flexible walls 2, 3 are distinct, the method is more particularly suitable for the manufacture of bags in a vertical manner, and in the case (FIG. 7) where the two flexible walls 2, 3 are derived from a folded sheet, the method is more particularly suitable for the manufacture of bags in a horizontal manner.

Reference numerals 38 and 39 (FIG. 2) designate two sheets of flexible but tearable material which are, for example, unrolled from rollers and simultaneously displaced facing one another, in the direction of an arrow B. The arrow B is preferably vertically oriented.

Along a plane perpendicular to this arrow, the two sheets 38 and 39 have the same dimensions and are disposed edge-to-edge. This dimension corresponds to substantially twice the width of an edge 6 or 8 of the bag 1. The example illustrated makes it possible for two bags 1 to be produced in a substantially simultaneous manner. The bags 1 are produced in such a way that their longest edges 7 and 9 are parallel to the arrow B.

The sheets 38 and 39 are brought into contact with each other by means 60 during their displacement in the direction of arrow B.

Once in contact, sheets 38 and 39 are rigidly joined so as to form a part of the margin 4 and of the volume 5. More specifically, at this stage only parts 15, 16 and 17 of the margin 4 are produced.

Two filling devices 40, 41 such as nozzles are fixed with respect to the sheets 38 and 39, which move along in the direction of arrow B. In addition, these nozzles 40 and 41 are disposed so as to extend into the interior of the volume 5 partially defined by parts 15, 16 and 17 of the margin which have just been rigidly joined.

The purpose of each nozzle 40 and 41 is to at least partly fill the part of the volume 5 already produced with a product. It can be different for each nozzle 40 and 41. The rigid joining of the two sheets 38 and 39 and, as a result, the creation of the peripheral margin 4, are then completed. This step makes it possible to seal the volume 5.

Then the line of weakest resistance 18 is formed. Several methods and equipment make it possible to obtain the line 18. For example, it can consist of a stamped line.

An optional marking 42 can then be performed on the margins 4 provided with the line 18.

In the case of FIG. 2, where the sheets 38 and 39 make it possible to simultaneously produce several bags 1 disposed transversely with respect to the direction of displacement B, it is convenient to proceed with a longitudinal cutting 43. This longitudinal cutting is substantially parallel to the direction of displacement B. The longitudinal cutting 43 leads to the creation of two bands of bags 1 all in one piece, in the direction of arrow B.

Then, a transversal cutting 44 operation is carried out, i.e., substantially perpendicular to the direction of arrow B, in order to separate the bags 1 of each band obtained by means of the longitudinal cutting 43.

FIG. 2 only makes up an example and it is also possible to manufacture more than two bags 1 simultaneously, or, one bag at a time. Furthermore, the invention makes it possible to produce packs of several bags all in one piece, where the bags 1 are not separated along the longitudinal direction of displacement B and/or along a transversal direction.

According to the method illustrated in FIG. 7, the walls 2, 3 are derived from one same sheet of flexible but tearable material 59 rolled into a reel 61, and the direction B in which the displacement and the transformation of the sheet 59 into bags 1 takes place is substantially horizontal.

As it runs off the reel 61, the sheet 59 passes through means 60 suitable for performing a longitudinal folding substantially parallel to direction B. The sheet 59 is thus folded lengthwise so as to form two breadths 62, 63.

Upon the completion of the folding by means 60, the two breadths 62, 63, which are intended to form the walls 2 and 3, respectively, are placed opposite one another. Here the folding is performed so as to correspond to the edge 8 of the bags 1.

Moving along the direction of displacement B, the walls 2, 3 are submitted to steps similar to those described above (FIG. 2) so as to obtain bags 1. Three filling means 40 consisting of mobile nozzles suitable for penetrating and withdrawing from the volume 5 defined by parts 15, 16 and 17 of the margin are provided here.

Once the volume 5 has been sealed, a line of weakest resistance 18 is formed on the parts made up of the joined walls 2, 3 by appropriate means 56. The line 18 is produced on the margin 4 and, for example, on part 15.

To separate the bags 1 provided with lines 18, cutting transversal with respect to the direction B is performed. Here this cutting 44 is vertical and is carried out along the plane to which the bags 1 are assimilated.

FIG. 6 shows a machine 45 making it possible to produce bags 1. Such a machine makes it possible to implement, for example, the method which has just been described with reference to FIG. 2.

The machine 45 comprises a frame 46 with a base 47. Various means are provided to transform sheets 38, 39 of flexible material moving along inside the machine in a direction B into flexible bags 1. For this purpose, the sheets 33, 34 are displaced opposite one another or through the means of the machine 45.

The machine 45 is shown with its equipment in a position withdrawn from the frame 46. Some of its parts are not shown.

Following the direction of displacement B, the machine 45 includes a drawer 48 to which are attached part of the equipment and means of the machine 45. The drawer 48 makes it possible to withdraw the devices attached to it from the frame 46 along a transversal direction with respect to the arrow B, for example. The drawer can, for example, be installed so as to slide on the frame 46.

Near the site where the sheets 38, 39 converge towards each other, means 49 are provided which are suitable for rigidly joining them. The means 49 comprise a plate 50 attached to the drawer 48.

Joining blocks 51, 52, 53 and 54 are fitted to the plate 50. The blocks 51, 52 and 53 are arranged in a direction substantially parallel to arrow B. They make it possible to form parts 15 and 17 of the margin of the bags 1 through heat welding, for example.

Here, two bags 1 are simultaneously produced, and the joining blocks 51 to 54 generally define the shape of two contiguous U's. Each U corresponds to one of the bags 1 to be produced.

Block 54 is disposed transversally with respect to direction B and makes it possible to join parts 14 and 16 of the margin. Here, the block first joins the parts 16 of the margin of a segment of sheets 38, 39 which has just been placed in front of the plate 50. Parts 15 and 17 of the margin are produced simultaneously.

Once the filling has been completed, this segment is displaced until the part of the volume 5 opposite to part 16 is facing block 54. And while parts 15, 16 and 17 of the margin of the next segment of sheets 38, 39 are produced, part 14 of the margin of the segment whose volumes 5 have just been filled is produced by block 54. This block thus makes up a means for sealing the volume 5 through the completion of the margin 4.

Draw roller means 55 act on the sheets 38, 39 to displace them inside the machine 45 in the direction B.

The purpose of the means indicated by reference numeral 56 is to produce lines of weakest resistance 18. The means 56 are fitted to the drawer 50 by means of a base 57. They form a passage which the sheets 38, 39 pass through and where an appropriate device, such as a cutting tool, produces the lines of weakest resistance.

The means 58 are arranged so as to perform the longitudinal cutting 43 making it possible to separate the joined sheets 38, 39 into two bands of bags 1 all in one piece.

In the case of FIG. 7, and with a horizontal displacement machine 45, the means 49 which perform the first joining of the walls 2, 3 are disposed at a distance, along direction B, from the means 54 suitable for producing the part 14 of the margin which seals the volume 5.

Figure 8:
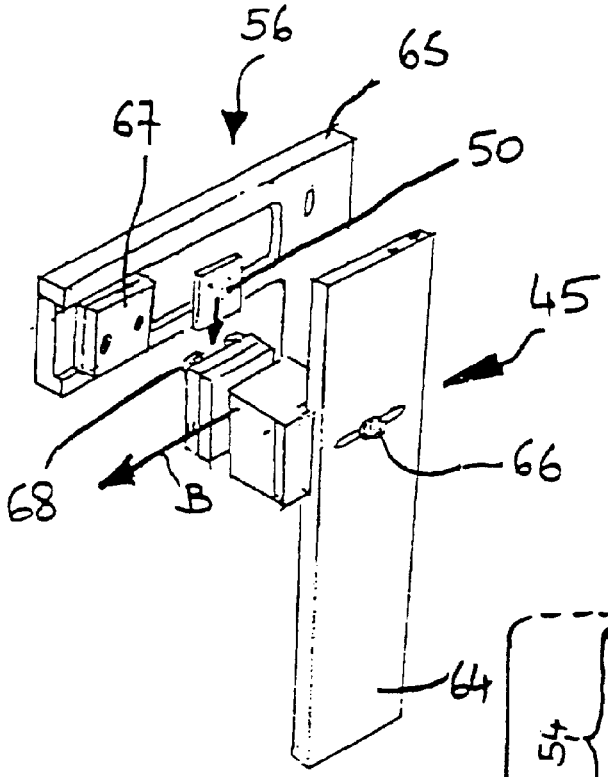
FIG. 8 is a partial perspective view of a piece of equipment and a machine for producing bags.

FIG. 8 shows part of a machine 45. This machine can work both vertically or horizontally.

This machine 45 includes two supports 64 and 65 disposed opposite to one another, on either side of the displacement path—along direction B—of at least one sheet of flexible material.

Plates 50 which are part of the means 56 are installed on the supports 64 and 65. They can be positioned with respect to one another, as well as with respect to the walls 2, 3 moving in the direction B, using respective adjustment means 66 and 67. These means 66 and 67, which can consist of slides or similar devices, make it possible to perform an adjustment along direction B. The installation of the plate 50 can be performed using rails 68. One of the plates is designed to receive equipment similar to blocks 51 to 54.

The invention is not limited to the embodiments illustrated and includes all of the modifications accessible to those skilled in the art.

What is claimed is:

1. A bag comprising a pair of flexible tearable walls defining between them a central volume for containing a product, said walls being secured together along and transversely of an elongated margin of substantial width extending between an outer edge of said bag and said central volume, and a line of weakness disposed in said margin, said line of weakness having a central portion extending lengthwise of said margin and opposite end portions, said central portion being disposed intermediate and spaced from opposite longitudinal edges of said margin, a first said end portion extending away from said central volume at an angle and intersecting said outer edge, a second said end portion extending toward said central volume and away from said central portion at an angle in a direction opposite the direction in which said first end portion extends and said walls being secured together over all the area between said opposite longitudinal edges of said margin.

2. A bag according to claim 1, said second end portion being spaced from said central volume by a substantial width of said margin.

3. A bag as claimed in claim 1, said central portion being straight and parallel to said outer edge.

4. A bag as claimed in claim 1, further comprising a bridge that interrupts said first end portion of said line of weakness.

5. A bag as claimed in claim 1, wherein said line of weakness is in the form of stamped line.

6. A bag as claimed in claim 1, wherein said bag is polygonal and said line of weakness occupies the greater portion of the length of one side of the polygonal bag.

7. A bag as claimed in claim 1, said central portion of the line of weakness being straight and said first end portion of said line of weakness being curved.

8. A bag as claimed in claim 1, said central portion of said line of weakness being straight and said second end portion of said line of weakness being curved.

9. A bag as claimed in claim 1, wherein said central volume comprises, near said second end of said line of weakness, a part protruding into the margin and toward said outer edge, said second end of said line of weakness pointing toward a concave marginal portion of said central volume at a base of said protruding part.

* * * * *

UNITED STATES PATENT AND TRADEMARK OFFICE

CERTIFICATE OF CORRECTION

PATENT NO. : 6,095,689
DATED : August 1, 2000
INVENTOR(S) : Bochet

It is certified that error appears in the above-identified patent and that said Letters Patent is hereby corrected as shown below:

Title page,
Insert -- [*] Notice: Under 35 U.S.C. 154(b), the term of this patent shall be extended for 484 days. --.

Signed and Sealed this

Eleventh Day of February, 2003

JAMES E. ROGAN
*Director of the United States Patent and Trademark Office*